United States Patent [19]

Vitols et al.

[11] 4,433,561

[45] Feb. 28, 1984

[54] GAUGE CHANGING APPARATUS

[75] Inventors: Reinhards Vitols, Tollerton; Steven Walkinshaw, Loughborough; John E. Baker, Birstall; Hywel R. Davies, Buntingford; Adrian M. Woodward, Bulwell, all of England

[73] Assignee: Corah Limited, Leicester, England

[21] Appl. No.: 288,942

[22] Filed: Jul. 31, 1981

[30] Foreign Application Priority Data

Aug. 2, 1980 [GB] United Kingdom ..... 8025309

[51] Int. Cl.[3] ..... D04B 9/40

[52] U.S. Cl. ..... 66/148

[58] Field of Search ..... 66/147, 148

[56] References Cited

U.S. PATENT DOCUMENTS 3,514,978 6/1970 Bliederhauser ..... 66/148

3,841,114 10/1974 Vandermeirsch ..... 66/148

3,913,358 10/1975 Dhondt ..... 66/148

4,336,697 6/1982 Vitols et al. ..... 66/148

*Primary Examiner*—Ronald Feldbaum

*Attorney, Agent, or Firm*—Charles E. Brown

[57] ABSTRACT

The present invention provides an apparatus for transferring knitted fabric from needles of a first knitting gauge to needles of a second knitting gauge. A row of parallel, elongate points are provided each being arranged parallel to one another and secured at each end to a movable frame. The bands pass through respective slots in two trick bars with the points being located between the two bars so that movement of the bands in unison carries the points from one trick bar to the other. If the slots in the respective trick bars are at the two selected knitting gauge then passage of the bands through the slots adjusts the spacing of the points from one gauge to the other.

16 Claims, 3 Drawing Figures

GAUGE CHANGING APPARATUS

The present invention relates to apparatus for transferring a knitted fabric from needles of a first knitting gauge to needles of a second, different knitting gauge. Such an apparatus is particularly useful in receiving batches of knitted fabric pieces, known as trims, from a magazine bar and transferring the trims to a second magazine bar, sometimes known as a running on bar. Typically a batch consists of up to 25 trims and a magazine bar is generally capable of receiving up to two batches.

In the manufacture of trims it is normal practice for trims, such as ribs and collars for knitted garments, to be knitted on a different type of machine to that on which the body of the garment is knitted. In order to complete the garment these trims have to be transferred either to the machine on which the body of the garment is knitted or to a linking machine used to attach the trims to the body. However, the knitting gauge of a machine used for knitting trims is frequently different to that of the machine on which the garment body is knitted and also to that of a linking machine, where used. In addition, when the trims are knitted it is often desirable to double the loops of the trim fabric on some of the knitting needles to give special patterning effects or to alter the elasticity of the trim fabric. The result of this, of course, is that when the knitting of a trim is completed some of the knitting needles are left without fabric loops. However, when the trim is transferred to a linking machine or to the knitting machine on which the garment body is knitted it is normal for each successive needle of the machine to be encompassed by at least one loop of the trim fabric. Transfer of the trim fabric loops to the machine needles is normally effected by manually transferring the loops to an intermediate magazine bar, the operation therefore being both time consuming and expensive and subject to considerable error, for example arising from lack of concentration of an operator through fatigue or otherwise.

Accordingly, the present invention provides an apparatus for transferring knitted fabric from needles of a first knitting gauge to needles of a second, different knitting gauge, the apparatus comprising a plurality of points movable between first and second positions to vary the knitting gauge of said points, the points being arranged in a substantially straight row in said first and second positions; and guide means for guiding said points between said first and second position.

The present invention is further described hereinafter, by way of example, with reference to the accompanying drawings, in which.

Figure 1:
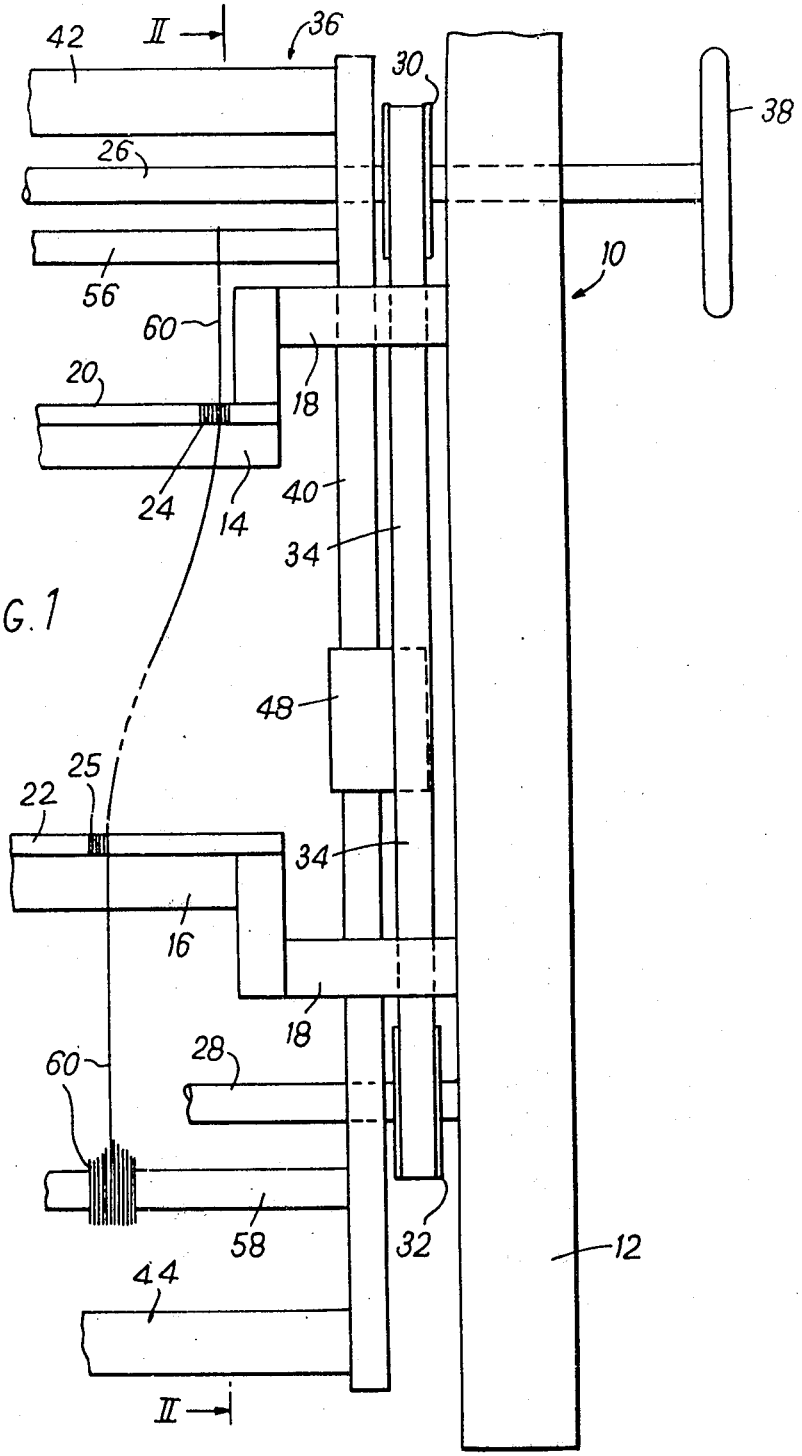
FIG. 1 is a front elevation of a righthand portion of a preferred form of apparatus according to the present invention.
Figure 2:
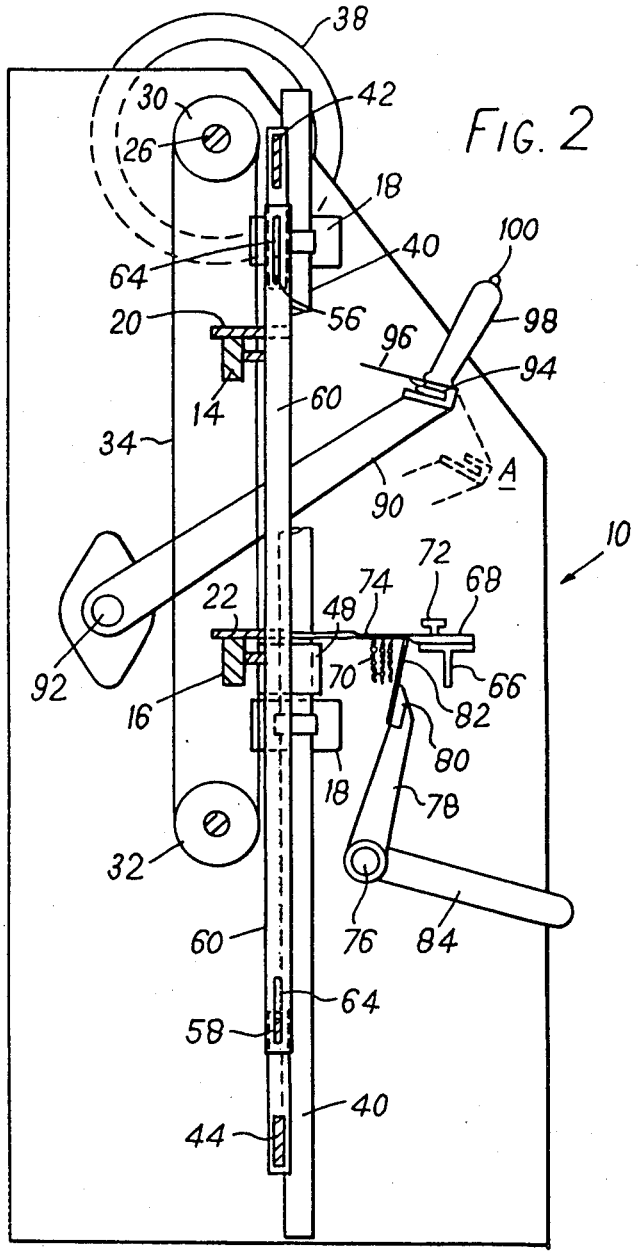
FIG. 2 is a part sectional view along the line II—II of FIG. 1.
Figure 3:
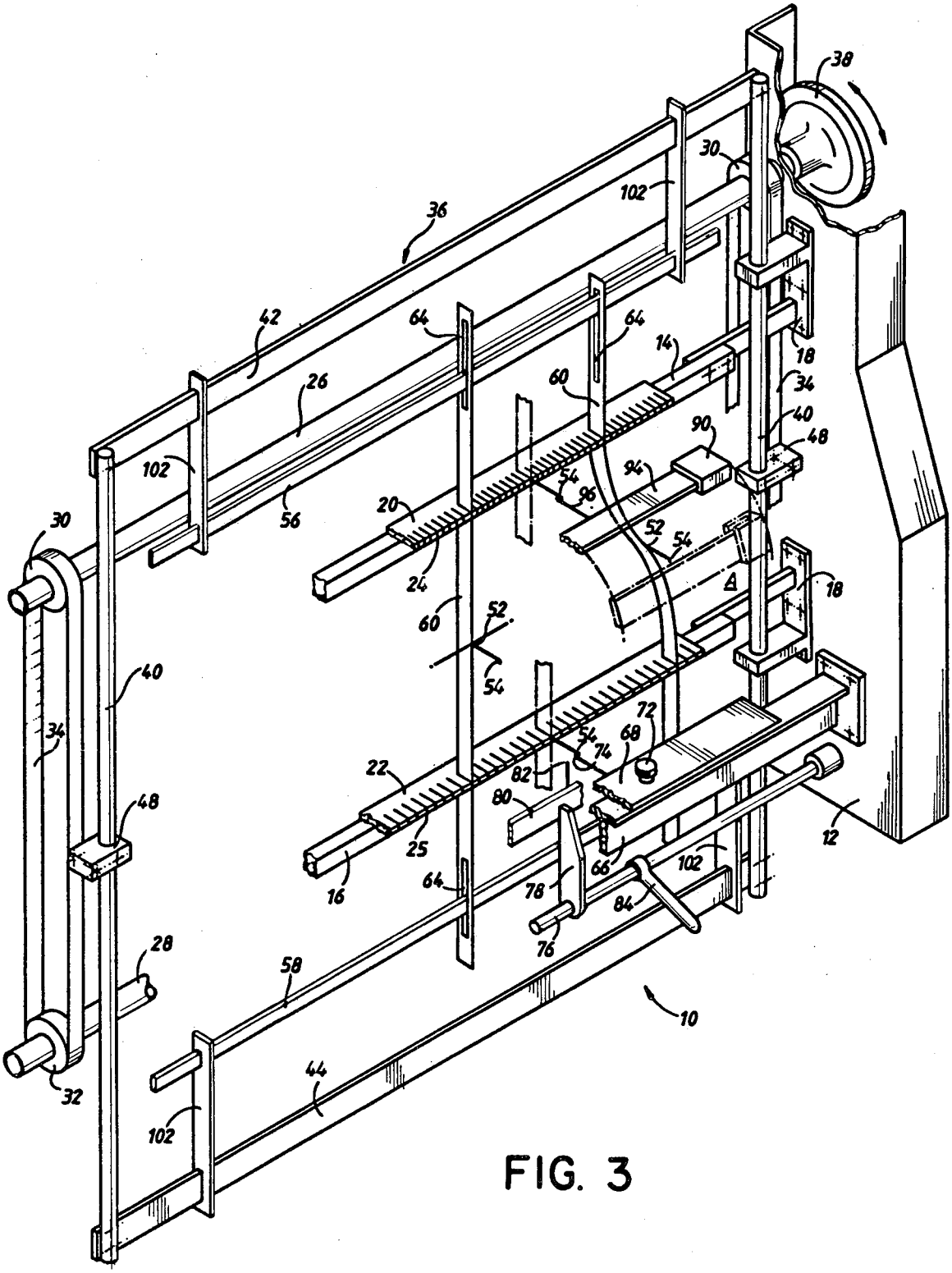
FIG. 3 is a perspective view of the apparatus of FIG. 1 with some parts broken away and others omitted for purposes of clarity.

In the drawings, certain parts shown in FIGS. 2 and 3 are omitted from FIG. 1 for purposes of clarity while parts of FIG. 3 are shown broken away and omitted also for the purposes of clarity.

The illustrated apparatus 10 has a rigid base frame which comprises substantially parallel side members 12. The two side members 12 are rigidly interconnected by two transverse members 14 and 16 secured to the side members 12 by trunnions 18. The members 14 and 16 are mounted substantially parallel with one another adjacent the upper and lower end regions respectively of the side members 12 as seen in the drawings. The transverse member 14 detachably mounts a trick bar 20 formed with uniformly spaced open ended slots 24 over the full length of the limb for reasons explained below. The transverse member 16 also detachably mounts a trick bar 22 also formed with uniformly spaced open ended slots 25 over the full length of the limb but at a different gauge to that of the slots 24.

The base frame also mounts two transverse axles 26, 28 which are freely rotatable and to which are secured adjacent one of the side members 12 two pulleys 30, 32 which carry an endless preferably toothed belt 34. The belt 34 pulleys 30, 32 and axles 26, 28 form part of a drive mechanism for a movable frame 36. The drive mechanism includes a drive wheel 38 secured to the axle 26. Although only one drive wheel 38 is shown two or even four may, of course, be used, a respective one secured to each axle. The drive wheel 38 is coupled to a suitable drive which may be manual or in the form of, for example, an electric motor. Rotation of the drive wheel 38 rotates the axle 26 and thus the pulley 30 to drive the belt 34 about its closed path. The pulleys 30, 32 and the belt 34 are preferably duplicated on the opposite side of the apparatus 10.

The movable frame 36 is substantially rectangular comprising upper and lower cross members 42, 44 and side members 40, the latter slidably passing through the trunnions 18. The endless belt 34 is secured to the movable frame 36 preferably midway along the length of the adjacent side member 40 by a bracket 48 so that when the belt 34 is moved by rotation of the pulleys 30, 32 the frame 36 moves with the belt 34, being guided by the engagement of the members 40 through the trunnions 18. Where a second belt 34 is provided on the opposite side of the apparatus 10 an additional bracket 48 also secures the adjacent side member 40 thereto.

The movable frame 36 is also provided adjacent each cross member 42, 44 with respective, substantially flat transverse support bars 56, 58, respectively, connected to the cross members 42, 44 by bars 102. The support bars 56, 58 carry a number of resilient strips or bands 60 therebetween extending substantially parallel with one another and passing through the respective slots 24 and 25 in the trick bars 20 and 22. The bands 60 are attached to the support bars 56, 58 by way of elongate slots 64 formed in the end regions of the bands 60 and through which the support bars are threaded. The lengths of the slots are somewhat greater than the width of the associated support bars to allow limited free movement of the bands 60 relative to the frame 36 in the direction of frame movement. The bands are preferably made of spring steel or similar material although plastics material may be used.

A respective point carrier 52 is secured to each band 60, each carrier 52 being an elongated bar of substantially rectangular cross-section which carries a respective point 54 substantially coaxial with the carrier 52. A convenient way of securing each point carrier to a band 60 is to sandwich the carrier between two resilient strips laminated to form a single band 60.

When the drive mechanism is activated to rotate the pulleys 30, 32 and thus the belt 34 the movable frame 36 is carried with the belt 34 by virtue of its attachment thereto through the bracket 48. As will as appreciated, since the points 54 are attached relative to the movable frame 36 by virtue of the attachment of the bands 60 to the support bar 56, 58, the points 54 will be carried with the movable frame 56 in its direction of movement after the lost motion provided by the engagement of the leading support bar in its associated band slots is taken up.

The base frame also mounts a T-bar 66 which is adapted to receive a magazine bar 68 carrying knitted trims 70. The magazine bar 68 is conveniently secured to the T-bar 66 by suitable means such as bayonet locking handles 72 to facilitate attachment and removal of the magazine bar 68. The position of the T-bar 66 on the base frame is such that when the magazine bar 68 is attached to the T-bar 66 the ends of its points 74 carrying the knitted trims 70 are juxtaposed with the points 54 of the point carriers 52 when the latter are engaged in the slots 25 in the lower trick bar 16. The base frame also pivotally mounts by way of an axle 76 two or more rocker arms 78 (only one is shown in the drawings) to the ends of which is detachably secured a finger bar 80. The finger bar 80 carries a number of fingers 82 which interleave with the points 74 such that pivoting of the rocker arms 78 in an anticlockwise direction causes the fingers 82 to sweep the trims 70 from the points 74 of the magazine bar 68 onto points 54. Pivoting of the rocker arms 78 is conveniently effected manually by means of one or more handles 84 (only one is shown in the drawings) attached to the axle 76.

Two coacting levers 90 are also pivotally mounted to the base frame on a pivot axis 92. The levers have substantially U-shaped slots at their ends remote from the pivot axis 92 for receiving a further magazine bar 94 which has points 96 to which the knitted trims 70 on the magazine bar 68 are to be transferred. The points 96 of the magazine bar 94 are at the gauge of a garment knitting machine or linking machine to which the trims 70 are to be transferred for combination with the garment body. The levers 90 are normally pivoted into the lower position A partly shown in chain lines in FIGS. 2 and 3 where the points 96 are held clear of the points 54. Pivoting of the points 96, for example, manually by way of handles 98 (only one handle 98 is shown in the drawings), brings the tips of the points 96 into juxtaposition with the tips of the points 54 when the carriers 52 of the latter are engaged in the slots 24 of the upper trick bar 20 to allow transfer of knitted trims from the points 54 to the points 96 preferably manually or using a finger bar as described above.

Either or both arms 90 may be pivoted by means of a ratchet mechanism to allow adjustment of the position of the magazine bar 94, either or both of the arms 90 mounting the pawl of the ratchet mechanism. Quick release of the ratchet mechanism may be easily effected, for example by way of a release button 100 on either or both handles 98.

The magazine bar 68 may also conveniently be supported by a mechanism similar to the above described mechanism supporting the magazine bar 94 for movement towards and away from the points.

Use of the apparatus to transfer knitted trims between knitting machines of different knitting gauge is described below. For illustrative purposes only the transfer of knitted trims from a first machine of knitting gauge 7 to a second knitting machine of knitting gauge 9 is described. It will be appreciated, however, that use of the apparatus is not limited to knitting machines of these gauges.

Prior to using the apparatus an operator first ensures that the correct trick bars 20 and 22 are mounted on the apparatus base frame, that is, in the present example the operator ensures that the spacing of the slots 25 in the trick bar 22 is equivalent to a knitting gauge of 7 and the spacing of the slots 24 in the trick bar 20 is equivalent to a knitting gauge of 9. If either of the trick bars 22, 20 is incorrect the operator replaces it with a trick bar of the correct gauge slots.

Initially knitting trims 70 are collected on the magazine bar 68 of the first knitting machine in a conventional manner. The points 74 of the magazine bar 68 are, of course, spaced for knitting gauge 7. The magazine bar 68 is then removed from the first machine and secured to the T-bar 66 of the illustrated apparatus with the fingers 82 of the finger bar 80 interleaved with the points 74. The drive mechanism of the illustrated apparatus is then activated to drive the movable frame 36 downwardly as seen in the drawings. As the frame 36 moves relative to the base frame the lower support bar 58 draws the bands 60 through the upper and lower trick bars 20 and 22 moving the point carriers 52 towards the trick bar 22, the spacing of the point carriers 52 and thus of the points 54 altering to conform with the spacing of the slots 25 in the trick bar 22. The loose engagement of the support bars in the band slots 64 ensures that regardless of the direction of movement of the frame 36 only the leading support bar acts on the bands 36. The latter are thus pulled in the desired direction to ensure smooth transport through the trick bar slots. As the frame 36 reaches its extreme lower position relative to the base frame the point carriers 52 are drawn into the slots 25 in the lower trick bar 22 thus bringing the tips of the points 54 into juxtaposition with the tips of the points 74. Naturally, since the spacing of the slots of the trick bar 22 is equivalent to the knitting gauge of of the points 74 the points 54 adopt the same knitting gauge of the former. The operator then pivots the rocker arm 78 anticlockwise to cause the fingers 82 to sweep the knitted trims 70 from the points 74 onto the points 54. The drive mechanism of the apparatus is then activated to drive the movable frame 36 upwardly as seen in the drawings, carrying the point carriers 52 and their points 54 from the trick bar 22 towards the trick bar 20 as the bands 60 pass through the slots 24 of the trick bar 20. As the point carriers 52 and their points 54 approach the trick bar 20 the passage of the bands 60 through the slots 24 of the trick bar 20 laterally spaces the carriers 52 which follow the movement of their associated bands 60. The carriers 52 adopt the spacing of the slots 24 in the trick bar 20 as the carriers 52 are eventually drawn into the slots 24 when the movable frame 36 reaches its upper extreme position.

The magazine bar 94 whose points 96 are arranged in knitting gauge 9 is engaged in the U-shaped slots in the levers 90 if it has not previously been so engaged. The levers 90 having previously been moved into their lowermost position A are now moved anticlockwise to their uppermost position in which the tips of the points 96 are juxtaposed with the tips of the points 54. The knitted trims 70 are then pulled, normally by hand, from the points 54 onto the points 96 of the magazine bar 94. The levers 90 are then pivoted clockwise again into their lowermost position and the magazine bar 94 removed for transfer to the second knitting machine.

With regard to the described apparatus it will be appreciated that the bands 60 may be arranged in any suitable combination so that, for example, points on the magazine bar 68 which do not carry loops of the knitted trims 70 due to doubling during knitting of the trims are not juxtaposed with points 54 of the apparatus, the respective bands 60 and their points 54 having previously been removed or repositioned in appropriate locations.

The trick bars 20 and 22 may conveniently be segmented, that is formed from discrete blocks, for example two or three inches in length. Where only a relatively few number of bands 60 are used segments may be removed or added to the trick bars 20 and 22 to provide as straight a pattern of movement for the unused bands 60 as is conveniently possible.

In a modification (not shown in the drawings) of the present invention the two trick bars 22 and 20 may be respectively of the smallest and largest knitting gauge which might be encountered. Additional trick bars are located at preselected intervals between the two end trick bars with each trick bar having a knitting gauge greater than the next adjacent lower trick bar. In this embodiment the frame 36 may be moved into positions intermediate its extreme positions to locate the points 54 in any one of the trick bars in which the knitting gauge lies in the range between the two extreme gauges available.

Suitable means may be provided to ensure positive movement of the frame 36 into such preselected positions, for example by provision of recesses in the outer surfaces of the side members 40 into which spring biassed balls (not shown in the drawings) in the trunnions 18 engage. In this embodiment, of course, the mounting positions of the two magazine bars 68 and 94 would need to be adjustable so that they may be positioned, where necessary, at locations adjacent any one of the trick bars corresponding to the preselected positions of the needles, for transfer of the knitted trims.

We claim:

1. An apparatus for transferring knitted fabric from needles spaced in accordance with a first pattern to neddles spaced in accordance with a second pattern, comprising a base; carrier means mounted on said base and movable in a first path on said base; a plurality of substantially parallel elongate points attached to said carrier means so as to be movable both laterally of said path and with said frame means between a first position wherein said points are spaced in accordance with said first pattern and a second position wherein said points are spaced in accordance with said second pattern; and guide means on said carrier means and said base for guiding movement of said points towards and away from one another laterally of said path to alter the spacing of said points as said points are moved along said path by said frame means from one of said first and second positions to the other.

2. An apparatus as claimed in claim 1 wherein said guide means comprises respective spacer means at each said position for spacing said points relative to one another in accordance with the respective pattern.

3. An apparatus as claimed in claim 2 wherein each said spacer means is detachably mounted on said base.

4. An apparatus as claimed in claim 2 wherein said guide means further comprises a plurality of elongate slide members attached to said carrier means each of which carries a respective point and is movable along said path to carry the associated point into engagement with said spacer means.

5. An apparatus as claimed in claim 4 wherein each said slide member comprises a resilient material strip.

6. An apparatus as claimed in claim 4 wherein each point is secured to its associated slide member upstanding relative thereto by way of a point carrier.

7. An apparatus as claimed in claim 4, wherein each said slide member is engaged in a respective opening in each said spacer means and is adapted to be drawn through said openings to move the associated point between said first and second positions.

8. An apparatus as claimed in claim 7 wherein each said spacer means is a respective trick bar extending transversely of said direction of movement such that said points are aligned substantially parallel with one another when engaged with respective slots in each said trick bar, said slots forming said openings.

9. An apparatus as claimed in claim 4 or 8 further comprising drive means mounted on said bade and coupled to said carrier means, said drive means being operable to move said carrier means between said first and second positions.

10. An apparatus as claimed in claim 4 or 8 wherein said slide members are coupled at each end region thereof to said carrier means.

11. An apparatus as claimed in claim 10 wherein said slide members are coupled to said carrier means such that said carrier means acts to exert a tensile force on said members whereby to draw said members towards said first and second positions.

12. An apparatus as claimed in claim 11 wherein said carrier means includes two elongate members extending substantially parallel with one another transversely of said path, said elongate members being loosely coupled to respective end regions of said slide members.

13. An apparatus as claimed in claim 12 wherein said elongate members are threaded through respective slots in the end regions of said slide members.

14. An apparatus as claimed in claim 12 wherein said elongate members are cross members of a substantially rectangular frame movable relative to said spacer means.

15. An apparatus as claimed in claim 1 or 8 further comprising first and second means on said base for detachably supporting respective needle arays at locations adjacent said first and second position such that the needles of said first and second arays and said points are juxtoposed when said points are respectively in said first and second positions for enabling transfer of said knitted fabric.

16. An apparatus as claimed in claim 15 wherein said first and second means are movable towards and away from said respective locations.

* * * * *